United States Patent [19]

Giessner

[11] 4,049,108

[45] Sept. 20, 1977

[54] ACTUATOR FOR A MATRIX PRINT HEAD

[75] Inventor: Frank Giessner, Augsburg, Germany

[73] Assignee: NCR Corporation, Dayton, Ohio

[21] Appl. No.: 709,739

[22] Filed: July 29, 1976

[30] Foreign Application Priority Data

Dec. 23, 1975 Germany ..... 2558380

[51] Int. Cl.[2] ..... B41J 3/04

[52] U.S. Cl. ..... 197/1 R; 101/93.05; 335/27 D

[58] Field of Search ..... 197/1 R; 101/93.05; 335/249, 250, 270–277

[56] References Cited

U.S. PATENT DOCUMENTS

| | | | |
|---|---|---|---|
| 2,524,127 | 10/1950 | Johnson | 197/1 R X |
| 3,876,050 | 4/1975 | Linder | 197/1 R |
| 3,904,011 | 9/1975 | Matschke | 197/1 R |
| 3,968,867 | 7/1976 | Stenudd | 197/1 R |
| 3,991,869 | 11/1976 | Berrey | 197/1 R |

FOREIGN PATENT DOCUMENTS

| | | | |
|---|---|---|---|
| 1,577,409 | 8/1969 | France | 197/1 R |

*Primary Examiner*—Ralph T. Rader
*Attorney, Agent, or Firm*—J. T. Cavender; Albert L. Sessler, Jr.; Elmer Wargo

[57] ABSTRACT

An actuator including a solenoid and a "U"-shaped leaf spring. One end of the leaf spring is fixed to one end of the solenoid and the other end (a free end) of the leaf spring is located near the opposite end of the solenoid and is free to be attracted to the opposite end of the solenoid when it is energized. An actuating element is fixed to the free end of the leaf spring and is brought into operative engagement with a record medium when the actuator is actuated. A plurality of the actuators are arranged in a circle in a frame to produce a print head of the wire matrix variety. The actuators can also be used to punch holes in a record medium.

5 Claims, 10 Drawing Figures

FIG. 1
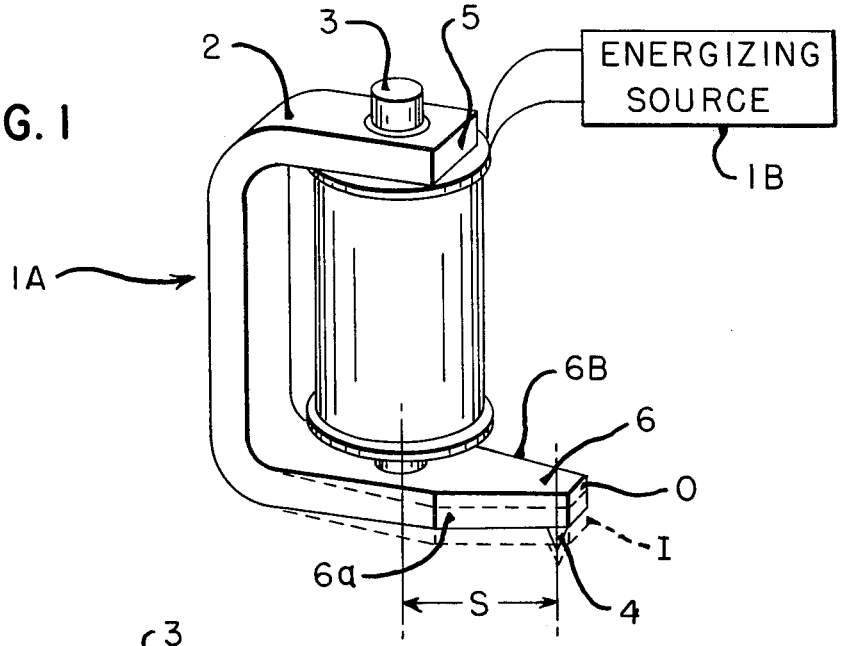
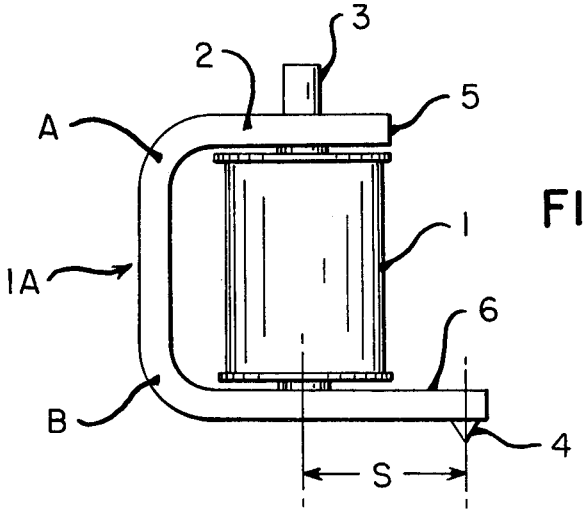
FIG. 2
FIG. 3B
FIG. 3A
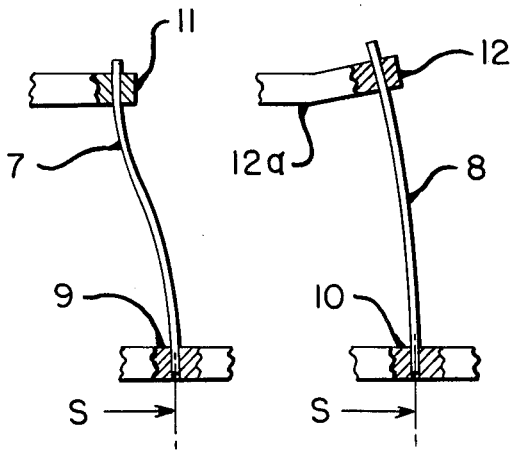

ACTUATOR FOR A MATRIX PRINT HEAD

BACKGROUND OF THE INVENTION

This invention relates to an actuator which may be used in a print head for the printing of characters made up of dots, lines or the like, or for the punching of holes in a record medium.

The actuator of this invention may typically be used in a matrix print head of the wire matrix variety. A wire matrix printer which is shown in British Pat. No. 1,288,710 utilizes a plurality of clapper type armatures for actuating the associated print wires and a plurality of leaf-type springs for returning the armature to a home or rest position. One of the disadvantages of a printer like the one just described is that a relatively large number of parts is necessary to manufacture the printer, resulting in an expensive production cost. While the wire matrix printer shown in the German Pat. No. 2,154,568 is of a more simple construction, it requires a plurality of U-shaped magnets and "tongues" to actuate the associated print wires, also resulting in expensive production costs.

In contrast with the above, the actuator of this invention contains a minimum number of parts to produce it, resulting in very economical production cost. In addition, the spring means associated with the magnet means is used both as a means to drive the associated actuator element (like a print wire) and as a means for completing a magnetic flux path associated with the magnet means.

SUMMARY OF THE INVENTION

This invention relates to an actuator which includes a magnet means like an electromagnet means having first and second ends and a spring means. The spring means has one end which is fixed to the first end of the electromagnet means and also has a free end which is located near the second end of the electromagnet means. The free end of the spring means has an actuating element on its free end, and the spring means is shaped to provide a magnetic flux path for the electromagnet means. Several of the actuators are formed into a wire matrix print head in one embodiment of the invention for use in printing on a record medium, and the actuators may alternatively be used for punching holes in a record medium.

BRIEF DESCRIPTION OF THE DRAWINGS

FIG. 1 is a general perspective view of an actuator built according to the principles of this invention, showing an electromagnetic means and a spring means;

FIG. 2 is a left side view in elevation of the actuator shown in FIG. 1;

FIG. 3A is a side view showing a portion of the spring means shown in FIG. 2 with a printing needle attached thereto;

FIG. 3B is a side view similar to FIG. 3A showing a modified end of the spring means and a printing needle attached thereto;

DETAILED DESCRIPTION OF THE INVENTION

Figure 4A:
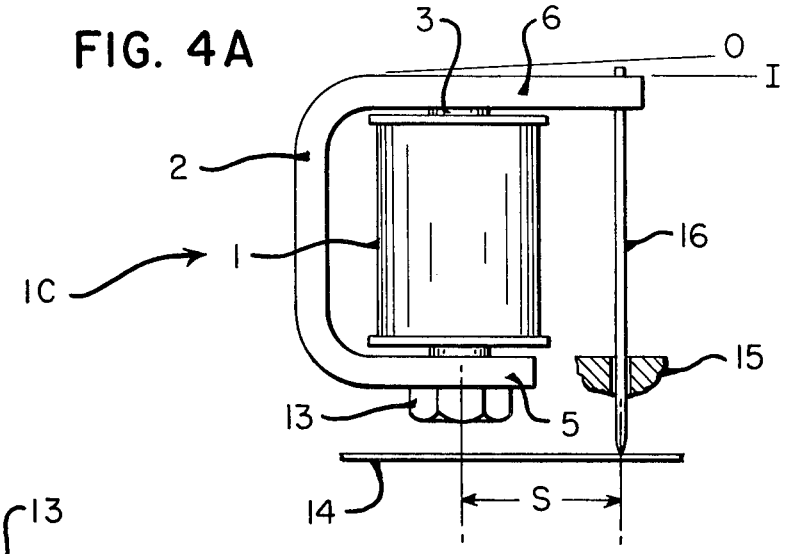
FIG. 4A is a side view in elevation of a slightly modified view of the actuator shown in FIG. 1 showing a different actuating element attached to the free end of the spring means.

FIG. 1 is a general perspective view of a device or actuator designated generally as 1A which is made according to the principles of this invention. The actuator 1A includes an electromagnetic means or a coil 1 which is connected to an energizing source 1B. The coil 1 includes a soft magnetic core 3 which intensifies or amplifies the magnetic flux flowing through the coil when it is energized. To complete an outer magnetic flux path, the actuator 1A is provided with an elastic or resilient spring means 2 which is made out of ferromagnetic material of low magnetic resistance. The spring means 2 is generally "U"-shaped and has a first or short leg 5 which is conventionally secured to a first end of the core 3, with the core 3 passing through the short leg 5 as shown, and also has a second end or longer leg 6 which is positioned near the second or opposite end of the core 3. An actuating element 4 (to be described subsequently in detail herein), is secured to one side of the longer leg 6 which is actually a free end. When the coil 1 is energized by the energizing source 1B, a magnetic flux is produced which causes the leg 6 of the spring means 2 to be attracted to and to contact the second end of the core 3.

Figure 6A:
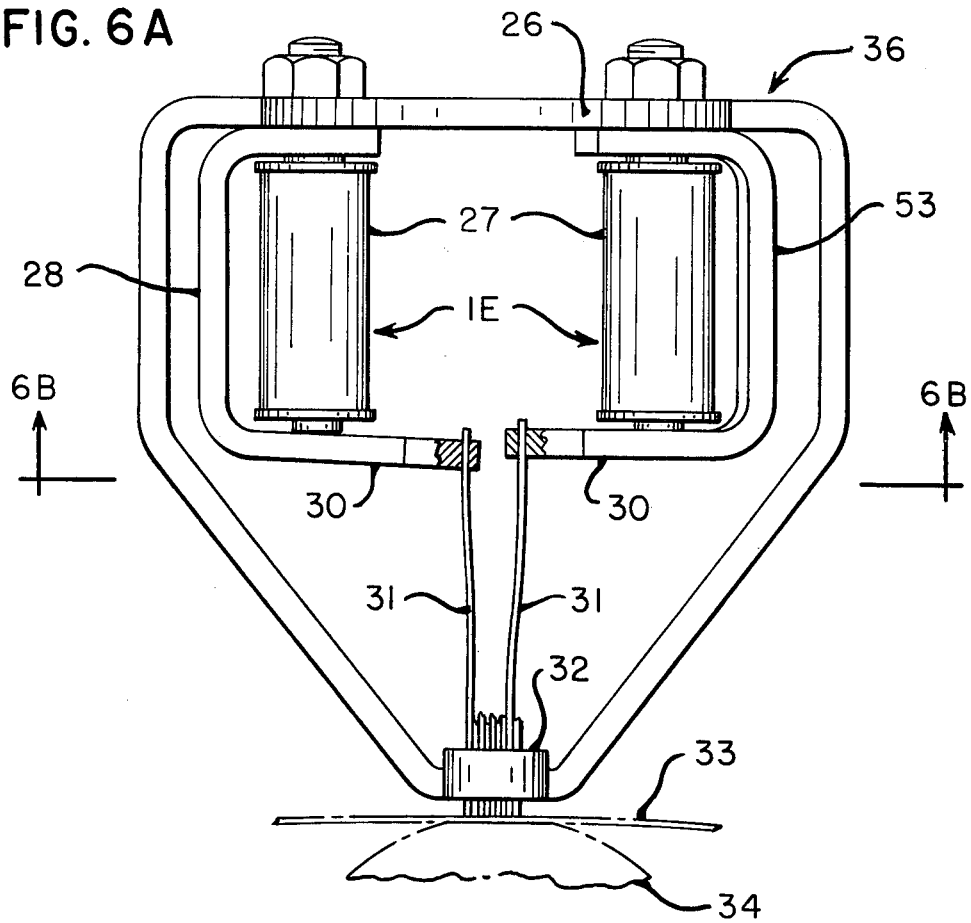
FIG. 6A is a cross-sectional view, in elevation, of a wire matrix print head formed by the actuators of this invention.
Figure 6B:
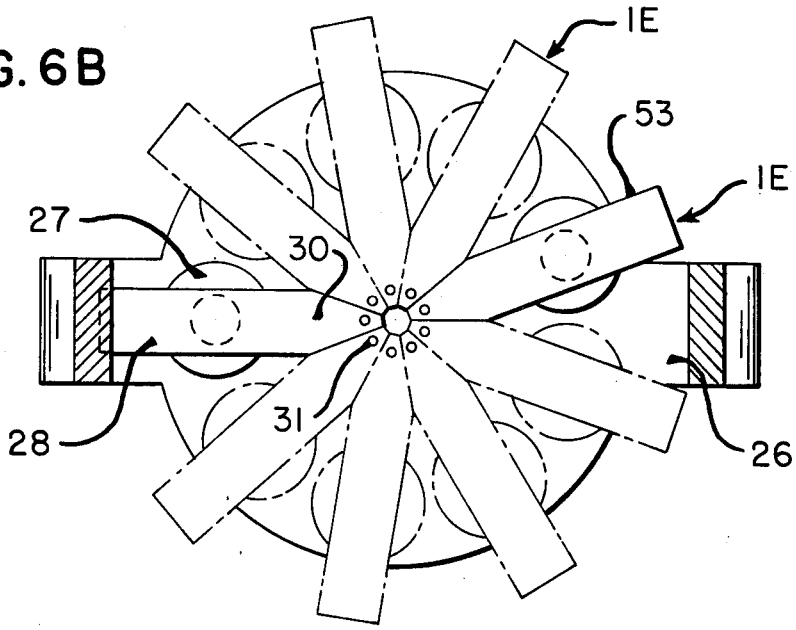
FIG. 6B is a cross-sectional view taken along the line C-D of FIG. 6A to show additional details of the wire matrix print head.

When the longer leg 6 is attracted to the core 3, the leg 6 is in a tensioned state as shown at postion "O" in FIG. 1. When the actuator 1A is to be actuated, the coil 1 is deenergized, and the energy which was stored in the U-shaped spring means 2 causes the leg 6 to be moved towards the postion shown by a dashed outline "I" in FIG. 1, thereby bringing the actuating element 4 into operative engagement with an element like a record medium (not shown). In the embodiment shown, the actuating element 4 may be shaped to enable the printing of a dot when brought into engagement with a record medium. The long leg 6 may have tapered sides **6*a* and 6*b* as shown in FIG. 1 and the leg 6 may be sufficiently long (as offset by the distance S, shown in FIG. 2) to enable several of the actuators 1A to be arranged in a circle (as shown in FIGS. 6A and 6B**) to form a matrix type print head. This feature will be described in more detail subsequently herein.

While the spring means 2, shown in FIGS. 1 and 2, is generally —U"shaped, having curved radii which are located at opposed ends of the coil 1, as shown at A and B in FIG. 2, it is apparent that the spring means 2 could be semi-circularly shaped and still work effectively. What is important is that the magnetic flux occurring between the ends of the coil 1 has a return path through the spring means 2.

In the embodiment of the actuator 1A shown in FIGS. 1 and 2, the actuating elements are located close to the leg 6, providing a low-cost actuator having a minimum of parts. In certain situations due to spatial requirements, it may be necessary to utilize long actuating elements like print wires 7 and 8 shown in FIGS. 3A and 3B. Only the longer leg 11 of the actuator is shown in FIG. 3A; however, leg 11 is identical to leg 6 shown in FIGS. 1 and 2. The print wire 7 is fixed to the leg 11 as shown, and due to the length of the print wire 7, a guide bearing 9 is used to guide the free end of the print wire 7 into operative or printing relationship with a record medium not shown. The letter "S" in FIG. 3A indicates the displacement of the print wire 7 from the longitudinal axis of the core 3 as was explained in relation to FIGS. 1 and 2. The print wire 8 shown in FIG. 3B is secured to one end 12 of the long leg (like 6 in FIG. 2) of the actuator and the other end of the print wire is guided in a bearing 10. The end 12 of the long leg is slightly offset as at 12*a* to enable the print wire 8 to assume the gentle arcuate shape shown, in contrast with the reverse bend shown in print wire 7 in FIG. 3A.

FIG. 4A shows an actuator 1C which is slightly different from the actuator 1A shown in FIGS. 1 and 2. The actuator 1C has a coil 1, spring means 2, core 3, first or short leg 5, and a second or longer leg 6 which are identical to the similarly numbered elements shown in FIGS. 1 and 2. The spring means 2 shown in FIG. 4A; however, is secured to the core 3 by a nut 13. A print wire 16 is conventionally secured to the second or longer end 6 of the spring means 2, and the free end of the print wire 16 is guided in a bearing 15. The print wire 16 is offset from the longitudinal axis of the core 3 by a distance S as shown.

The actuator 1C is operated differently from the actuator 1A shown in FIGS. 1 and 2 in that when the spring means 2 is in the relaxed condition, it assumes the position shown by dashed line O. When the actuator 1C is to be energized, the coil 1 is energized by an energizing source (like 1B shown in FIG. 1) causing the longer end 6 of the spring means 2 to be attracted to the core 3 (to the position shown by I) causing the print wire 16 to be brought into operative engagement with a record medium 14 to print a mark or dot thereon. An inked ribbon (not shown) would naturally be located between the print wire 16 and the paper 14 to effect the printing thereon. After the printing is effected, the coil 1 is deenergized, causing the longer leg 6 to assume the position shown by the dashed line O.

Figure 4B:
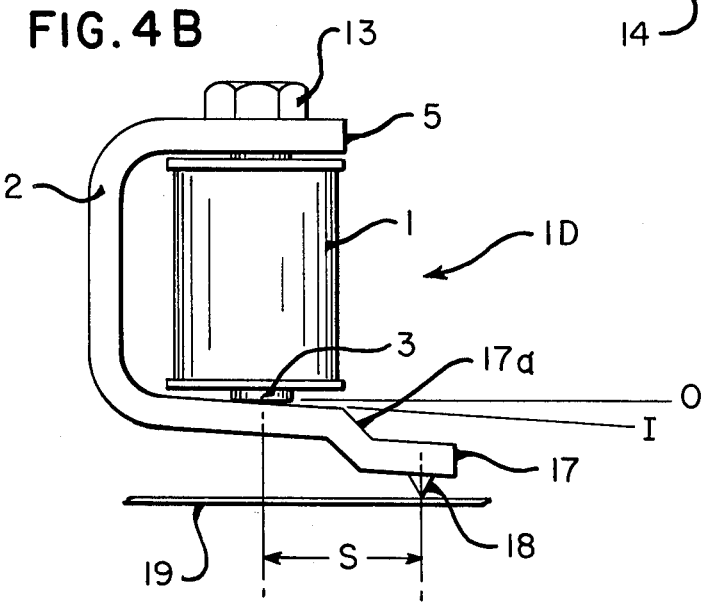
FIG. 4B is a view similar to FIG. 2 showing a slightly modified actuator according to this invention in which the free end of the spring means has a slightly offset portion thereon.

The actuator 1D shown in FIG. 4B is generally similar to the actuator 1C shown in FIG. 4A; however, the longer leg 17 of the spring means 2 in FIG. 4B is slighty offset as at 17*a*. This offsetting of the leg 17 enables a displacement of the longer leg 17 (in the longitudinal direction of the core 3) while the actuating elements 18 is dispaced laterally from the core 3 by a distance S. In contrast with the actuator 1C, when the coil 1 of actuator 1D is energized, the second leg 17 assumes the position shown by the dashed line O to tension the spring means 2. When the coil 1 is deenergized, the second leg 17 moves towards a record medium 19 to print thereon.

Figure 5:
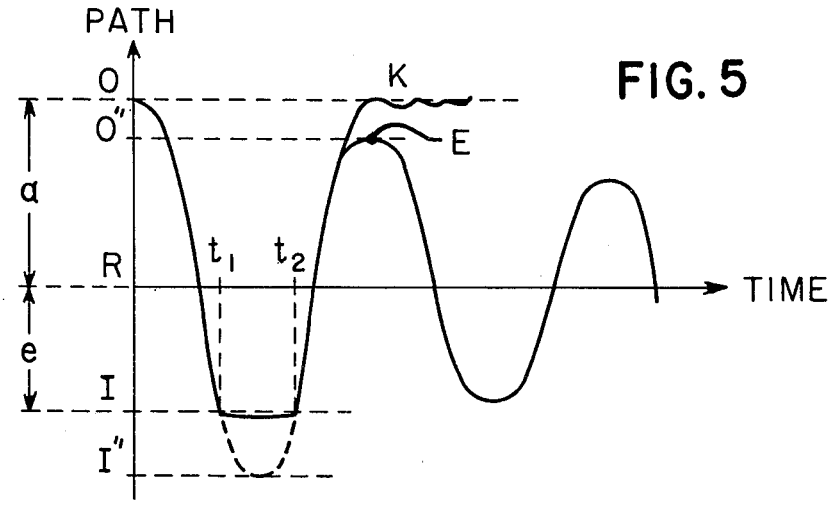
FIG. 5 is a diagram showing the movement of the free end of the spring means of the actuator of this invention during actuation.

FIG. 5 is a diagram representing the path or movement of the longer leg 6 of the spring means like 2 in FIG. 1, for example, during actuation of the actuator. The vertical axis of the diagram as measured in the direction marked "*a*" represents the displacement of the longer leg 6 from its rest or relaxed position which is marked "R." Time is shown on the horizontal axis. When the coil 1 is energized, the leg 6 is tensioned for a distance *a* to the point marked O. When the coil 1 is deenergized, and the leg 6 is released, the leg 6 moves toward the record medium at a speed determined by its resonant frequency. The leg 6 is released at time $t_0$ and time $t_1$ the actuating element 4 on leg 6 reaches the impact position marked I to effect the printing or punching relationship with the record medium. The printing or punching function is effected at a distance "*e*" from its rest position R prior to the leg 6 reaching its maximum free deflection (at I) which again is determined by its resonant frequency. At time $t_2$, the actuating element 4 moves out of contact with the record medium, and the leg 6 moves towards the end of the coil 1. Due to a loss in energy, the leg 6 will no longer come in contact with the core 3, but will reach a maximum return point marked O and thereafter continue to oscillate according to a damped sinusoidal vibration.

In order to effect an accelerated return of the leg 6 to the coil 1 which is free of oscillations or vibrations, the coil 1 is energized before the leg 6 has reached the maximum return point marked O in FIG. 5, resulting in the leg 6 following the curve marked "K." It is apparent from the curve K, that the leg 6 abuts against the core 3 of the coil 1 with very few oscillations or vibrations. The trace and the time relationships shown in FIG. 5 can be viewed on an oscilloscope, and the optimum control points for firing and reenergizing the coil 1 so as to effect a minimum of unnecessary vibrations of the leg 6 can be determined therefrom. The balance of the trace shown in FIG. 5 from the point marked E to the right represents the natural damping of the oscillations of the leg 6 if it were left free to oscillate.

FIG. 6A shows a sectional view of a print head designated generally as 36 which is comprised of actuators like 1A, 1B, for example, already disclosed herein. In the print head 36, only two actuators 1E are shown in FIG. 6A in order to simplify the drawing. The actuators 1E are mounted in a frame means 26 by utilizing nuts 24 which mate with a threaded end 25 of the core of the coil 27. The actuators 1E are arranged in the frame means 26 on a circle 53 as shown in FIG. 6A. The spring means 28 of each actuator has a long leg 30 to which a print wire 31 is secured, as was shown in FIG. 3A. The lower ends of the print wires 31 are movably guided in a bearing 32, and the ends of the print wires 31 are aligned in a straight line as is customarily done in wire matrix printers. The actuator 1E located on the left in FIG. 6A is shown in the "fired" or printing position in relation to a record medium 33 supported by a platen 34, while the actuator 1E located on the right is shown in the tensioned position prior to firing the actuator by deenergizng the coil 27. No ink ribbon is shown between the ends of the print wires 31 and the record medium 33 in order to simplify the drawing.

Figure 7:
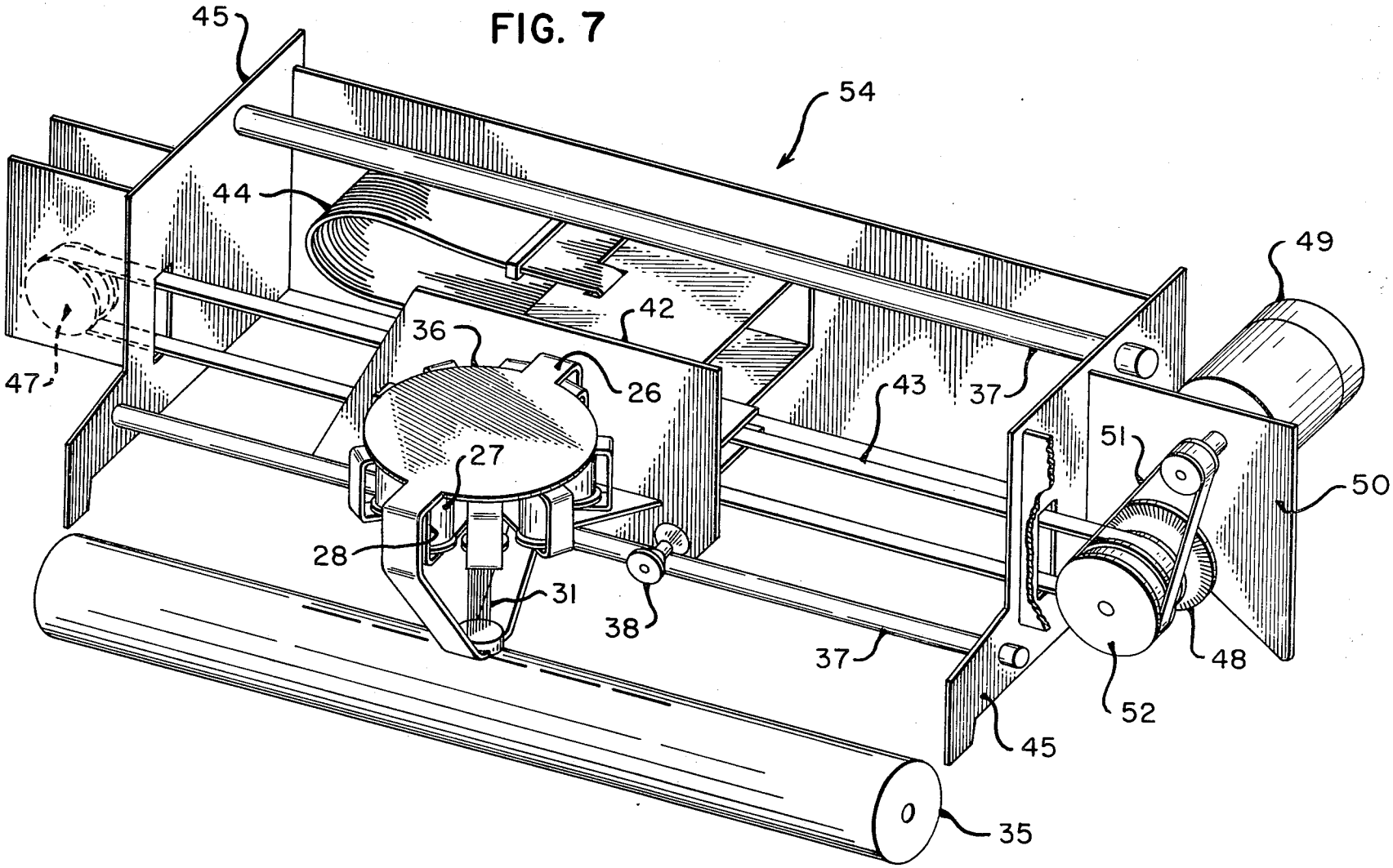
FIG. 7 is a general perspective view of a printer which utilizes the print head of this invention shown in FIGS. 6A and 6B.

FIG. 7 is a general perspective view of a printer 54 which utilizes the print head 36 shown in FIGS. 6A and 6B. The print head 36 is secured to a carriage means or support 42 which has rollers 38 extending therefrom which cooperate with a pair of spaced, parallel statiinary rods 37 to enable the print head 36 to be conventionally traversed along a platen 35 in printing relationship therewith. The rods 37 are supported in a pair of side frames 45. The support 42 with the print head 36 thereon is traversed along the platen 35 by an endless belt 43 which is secured to the support 42. The belt 43 is supported in a pulley 47 and a drive wheel 52 which is rotatably supported on a plate 50. The drive wheel 52 has a conventional timing disc means 48 associated therewith for conventionally controlling the position of the print head 36 along the platen 35. The drive wheel 52 and timing disc 48 are rotated by a reversible motor 49 via an endless belt 51.

A flexible control cable 44 (FIG. 7) is used to supply the individual actuators of the print head 36 with the required energizing energy.

While the actuators like 1A, 1C, for example, have been described in relation to printing on a record medium, they can also be used to punch holes in a record medium.

It is also apparent that a print head 36 which is comprised of the actuators disclosed herein is very simple and economical to produce. The material selected for the spring means like 2, for example, may be made of most any soft magnetic material. In general non-magnetic austenitic steels are unsuitable for use as the spring means 2. In one embodiment, standardized material DIN-German Industrial Standard 1.1012 steel was successfully used. The particular material selected for use in the spring means 2 would naturally depend upon the specific application in which the actuators of this invention are used. In a preferred form the spring means 2 is made of a single piece of such suitable material referred to above. In general, high printing speeds using the print head 36 are obtained when the materials selected for the spring means, like 2, provide for low self-damping for the purpose of attaining high frequencies of oscillation, and the coils 1 are switched on and off quickly.

What is claimed is:

1. An actuator comprising:

a magnet means having first and second ends; and a spring means having one end fixed to said first end of said magnet means and also having a free end located near said second end and having an actuating element on said free end;

said spring means being shaped to provide a magnetic flux path for said magnet means; and said spring means being generally U-shaped and formed from a single piece of magnetic material, and said magnet means being an electromagnet means.

2. The actuator as claimed in claim 2 in which said free end of said spring means is longer than said one end of said spring means which is fixed to said first end of said electromagnet means and in which said actuating element is shaped to print a dot on a record medium which is placed in printing relationship therewith; and in which said actuating element is moved into operative engagement with a cooperating member whenever said electromagnet means is energized.

3. An actuator comprising:

an electromagnet means having first and second ends;

a spring means having one end fixed to said first end of said electromagnet means and a free end located near said second end and having an actuating element on said free end;

said free end of said spring means being attracted to said second end of said electromagnet means to thereby tension said spring means whenever said electromagnet means is energized;

said actuating element being moved into operative engagement with a cooperating member whenever said electromagnet means is deenergized; and said spring means being generally U-shaped and being made of a single piece of magnetic material.

4. The actuator as claimed in claim 3 in which said free end of said spring means is longer than said one end of said spring means which is fixed to said first end of said electromagnet means and said actuating element is shaped to print a dot on a record medium associated with said actuator.

5. A matrix print head comprising:

a frame means, and a plurality of actuators arranged in a circle on said frame means;

each said actuator comprising:

an electromagnet means having first and second ends; and a spring means having one end fixed to said first end of said electromagnet means and also having a free end located near said second end and having an actuating element on said free end;

said spring means being shaped to provide a magnetic flux path for said electomagnetic means, said frame means also having a guide means thereon to guide said actuating elements of said actuators into operative engagement with a record medium:

each said free end of said spring means being longer than said one end of the associated said spring means which is secured to said first end of the associated said electromagnet means; said free ends of said spring means being tapered to enable said free ends to be arranged in a circle which is smaller than and concentric with said circle on which said plurality of actuators is arranged; and each said spring means being generally U-shaped and being made of a single piece of magnetic material.

* * * * *